US010177442B2

(12) United States Patent
Ozden et al.

(10) Patent No.: US 10,177,442 B2
(45) Date of Patent: Jan. 8, 2019

(54) MULTI-PART RADIO APPARATUS

(71) Applicant: Conversant Wireless Licensing S.a.r.l., Luxembourg (LU)

(72) Inventors: Sinasi Ozden, Soborg (DK); Benny Boegvad Rasmussen, Hvidovre (DK); Jani Ollikainen, Helsinki (FI)

(73) Assignee: Conversant Wireless Licensing S.a r.l., Luxembourg (LU)

( * ) Notice: Subject to any disclaimer, the term of this patent is extended or adjusted under 35 U.S.C. 154(b) by 0 days.

(21) Appl. No.: 15/355,439

(22) Filed: Nov. 18, 2016

(65) Prior Publication Data

US 2017/0069959 A1 Mar. 9, 2017

Related U.S. Application Data

(63) Continuation of application No. 12/310,752, filed as application No. PCT/IB2006/003644 on Sep. 6, 2006, now Pat. No. 9,531,057.

(51) Int. Cl.

| | |
|---|---|
| ***H01Q 1/24*** | (2006.01) |
| ***H01Q 1/48*** | (2006.01) |
| ***H01Q 9/04*** | (2006.01) |

(52) U.S. Cl.

CPC ..... *H01Q 1/243* (2013.01); *H01Q 1/48* (2013.01); *H01Q 9/0421* (2013.01)

(58) Field of Classification Search

None

See application file for complete search history.

(56) References Cited

U.S. PATENT DOCUMENTS

| | | | | |
|---|---|---|---|---|
| 7,659,793 | B2 * | 2/2010 | Fukushima | H01Q 1/3275 333/17.1 |
| 2003/0216150 | A1 * | 11/2003 | Ueda | H01Q 1/242 455/552.1 |
| 2007/0105602 | A1 * | 5/2007 | Takebe | H01Q 1/242 455/575.3 |

FOREIGN PATENT DOCUMENTS

JP 2005057664 A * 3/2005

* cited by examiner

*Primary Examiner* — Howard Williams

(74) *Attorney, Agent, or Firm* — Conversant Wireless Licensing

(57) ABSTRACT

An apparatus including an antenna; a first part including a first ground plane portion; a second part including a second ground plane portion; a first electrical connection between the first part and a second part; and a second electrical connection between the first ground plane portion and the second ground plane portion that includes a reactive component.

16 Claims, 1 Drawing Sheet

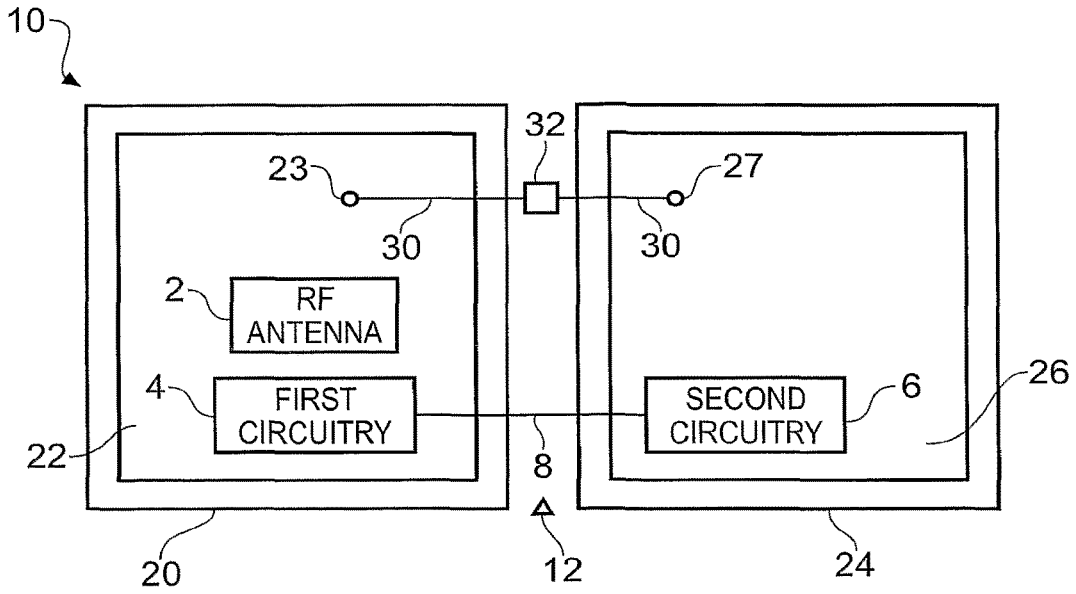
Fig. 1
Fig. 2
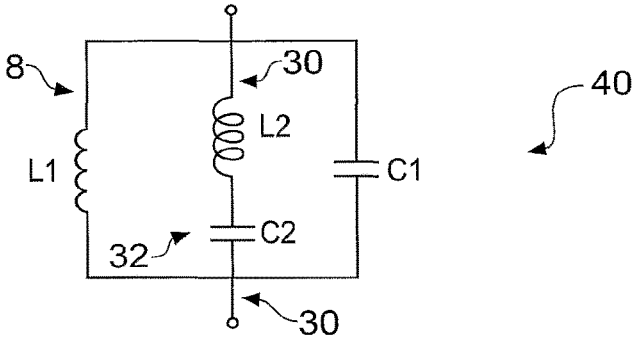
Fig. 3
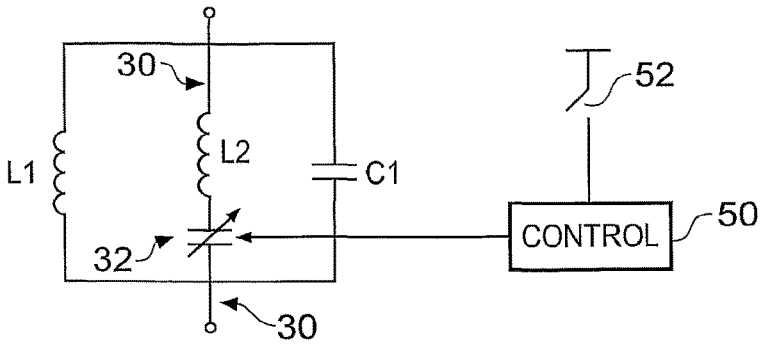

MULTI-PART RADIO APPARATUS

CROSS-REFERENCE TO RELATED APPLICATIONS

This application is a continuation of U.S. patent application Ser. No. 12/310,752, filed on Mar. 5, 2009 which was the National Stage of International Application No. PCT/IB2006/003644 filed Sep. 6, 2006. The above-identified application is herein incorporated by reference in its entirety.

FIELD OF THE INVENTION

Embodiments of the present invention relate to a multi-part radio apparatus.

BACKGROUND TO THE INVENTION

The operation of an antenna is influenced by the arrangement of conductive elements in its vicinity and the performances of some antennas, such as planar inverted F antennas, are improved by using a conductive ground plane.

In a single part radio apparatus, optimal performance of the antenna may be achieved by adjusting the ground plane, for example, by adjusting its dimensions. For example, the optimal length of ground plane for operation at EGSM900 is of the order of 10 cm.

A multipart radio apparatus may have a ground plane formed from a combination of a conductive element in one part and a conductive element in another part. The separation of the ground plane into two interconnected parts typically makes the length of the ground plane too long or of indeterminate length as each part typically needs to have a length greater than 5 cm to be usable and the interconnection adds to the length in an unquantified manner.

It would be desirable to optimise performance of an antenna in a multi-part apparatus.

BRIEF DESCRIPTION OF THE INVENTION

According to one embodiment of the invention there is provided an apparatus comprising: an antenna; a first part comprising a first ground plane portion; a second part comprising a second ground plane portion; a first electrical connection between the first part and the second part; and a second electrical connection between the first ground plane portion and the second ground plane portion that includes a reactive component.

This provides the advantage that the performance of the antenna may be optimised by selecting an appropriate reactive component. The use of a capacitive component shortens the electrical length of the first part, first electrical connection, second part combination.

BRIEF DESCRIPTION OF THE DRAWINGS

For a better understanding of the present invention reference will now be made by way of example only to the accompanying drawings in which:

FIG. 1 schematically illustrates a multipart radio apparatus;

FIG. 2 schematically illustrates the electrical circuit that joins the first part and the second part; and FIG. 3 schematically illustrates a different embodiment of the electrical circuit that joins the first part and the second part.

DETAILED DESCRIPTION OF EMBODIMENTS OF THE INVENTION

FIG. 1 schematically illustrates a multipart radio apparatus 10. The apparatus 10 comprises an antenna 2 for radio communication, a first part 20 and a second part 24.

The antenna 2 uses a ground plane and has at least one operational resonant frequency and may have multiple operational resonant frequencies. The antenna 2 may be, for example, a planar inverted F antenna (PIFA).

The apparatus 10 may, in some embodiments, operate as a mobile cellular telephone. The operational resonant frequency (or frequencies) may correspond with one (or more) of the cellular communication bands, such as: US-GSM 850 (824-894 MHz); EGSM 900 (880-980 MHz); PCN/DCS1800 (1710-1880 MHz); US-WCDMA1900 (1850-1990) band; WCDMA21000 band (Tx: 1920-1980|Rx: 2110-2180); and PCS1900 (1850-1990 MHz).

It is important that the combination of antenna resonant frequency and bandwidth at the operational resonant frequency of the antenna 2 are such that input impedance S11 of the antenna 2 is sufficiently low over the whole of the desired communication band.

The first part 20, in this example houses a first printed wiring board (PWB) 22 that operates as a first portion of the antenna ground plane. The PWB 22, in this example, carries the antenna 2 and also first circuitry 4.

The second part 24, in this example houses a second PWB 26 that operates as a second portion of the antenna ground plane. The second PWB 26, in this example, carries the second circuitry 4.

The first part 22 and the second part 24 are separated by an interface area 12, which in some embodiments includes a hinge that enables relative rotational movement of the first and second parts, so that the apparatus 10 may be folded between a closed configuration in which the first and second PWBs overlap and an open configuration in which the first and second PWBs are offset.

The first circuitry 4 and the second circuitry 6 are electrically connected by a first electrical connector 8 that crosses the interface area 8. The first electrical connector 8 may be a coaxial cable or a combination of flexible cables. A coaxial cable comprises a conductor for carrying data that is shielded by another conductor, typically a conductive sheath.

A second electrical connector 30 extends between a first connection point 23 at the first PWB 22, across the interface area 12, to a second connection point 27 at the second PWB 26. It may be a simple galvanic connector. It is typically physically shorter than the first electrical connector 8.

The second electrical connector 30 includes a lumped reactive component 32 that is connected in electrical series. The reactive component 32 in one embodiment is a capacitor. The capacitor may have a capacitance of between 0.5 and 10 pF. The reactive component in another embodiment is an inductor.

The second electrical connector 30 is in electrical parallel connection with the first electrical connection 8. The second electrical connector has affixed physical length and an electrical length controlled by the reactive component 32.

The reactance value of the reactive component 32 is chosen to optimise the performance of the antenna 2. The reactive component forms part of an equivalent electrical circuit 40, as illustrated in FIGS. 2 and 3, for the ground plane. The reactive component 32 is chosen so that the electrical circuit 40 has a resonant frequency (e.g. half wavelength dipole mode) that matches the operational resonant frequency of the antenna. If the antenna has multiple operational frequencies (e.g. half wavelength and full wavelength dipole modes), the resonant frequency of the circuit 40 may match the lowest resonant operational frequency.

The resonant frequency of the electrical circuit 40 matches an operational frequency when it equals that operational frequency or when it is sufficiently close to the operational frequency to improve the performance of antenna 2.

For example, a variation in the reactance value by can degrade the performance of the antenna by shifting the operational resonant frequency of the antenna and/or decreasing the bandwidth of the antenna such that the input impedance of the antenna 811 is no longer sufficiently low over the whole of the desired communication band.

For example, doubling the reactance value degrades the performance of the antenna by shifting the operational resonant frequency of the antenna and/or decreasing the bandwidth of the antenna 2.

For example, halving the reactance value degrades the performance of the antenna by shifting the operational resonant frequency of the antenna and/or decreasing the bandwidth of the antenna 2.

FIG. 2 schematically illustrates the electrical circuit 40 that joins the first part 22 and the second part 26.

The first electrical connector 8 has an inherent inductance L1. The second electrical connector 30 has an inherent inductance L2 and is serially connected to the reactive component 32 which has a capacitance C2.

The first electrical connector is typically longer than the second electrical connector and consequently has a larger inductance i.e. L1>L2.

There is also an inherent capacitance C1 between the first and second parts, in particular the first and second PWBs. The inductance L1, the series combination of L2 and C2 and the capacitance C1 are connected in parallel.

The values L1, L2, C1 are determined by the design of the apparatus 10. The value of the reactive component 32, C2, has a fixed constant value that has been chosen so that the resonant frequency of the circuit 40 matches a resonant operational frequency of the antenna 2 as described previously.

The impedance Z of the circuit 40 can be expressed as:

$$Z=X_{C1}//X_{L2}+X_{C1}//X_{C1} \quad \text{—1}$$

which can be expanded to:

$$Z=\frac{i\cdot\omega^2\cdot L1\cdot(\omega^2\cdot C2\cdot L2-1)}{-(\omega^2\cdot C2\cdot L2-1)\cdot(\omega^2\cdot L1\cdot C1-1)+\omega^2\cdot C2\cdot L1}$$

The nominator determines series resonance (minimum input impedance, but maximum internal impedance) and the denominator determines parallel resonance (minimum internal impedance but maximum input impedance).

The parallel resonance is tuned by selection of the appropriate value of C2 to optimize antenna performance (i.e. operative resonant frequency and/or bandwidth at that frequency).

FIG. 3 schematically illustrates a different embodiment of the electrical circuit 40 that joins the first part 22 and the second part 26.

The first electrical connector 8 has an inherent inductance L1. The second electrical connector 30 has an inherent inductance L2 and is serially connected to the reactive component 32 which has a capacitance C2. There is also an inherent capacitance C1 between the first and second parts, in particular the first and second PWBs. The inductance L1, the series combination of L2 and C2 and the capacitance C1 are connected in parallel.

The values L1, L2, C1 are determined by the design of the apparatus 10. The value of the reactive component 32, C2, has a variable value that is controlled by controller 50.

The controller 50 receives an input from configuration switch 52. The configuration switch 52 indicates the relative positions of the first part 20 and the second part 24. For example, if the apparatus 10 is a foldable phone, when the phone is closed a first signal is detected by the controller whereas if the phone is open a second signal is detected by the controller when the switch is interrogated. In the closed configuration, the first PWB 22 and the second PWB 26 are closer than in the open configuration. As a consequence, in the closed configuration, the value C1 is greater than in the open configuration. The controller 50 controls the variable reactive component to have a first reactance value in the closed configuration and a second reactance value in the open configuration. The reactance values are chosen to maintain optimal performance of the antenna and to prevent a degradation of antenna performance when the configuration of the apparatus 10 is changed.

Although embodiments of the present invention have been described in the preceding paragraphs with reference to various examples, it should be appreciated that modifications to the examples given can be made without departing from the scope of the invention as claimed. For example, in other embodiments, the apparatus 10 may have more than two parts and a connector 30 with reactive component 32 may be used to connect a first part with a second part and a similar connector, with perhaps a different reactive component, may be used to connect the second part with a third part.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. An apparatus comprising:

an antenna;

a first part comprising a first ground plane portion;

a second part comprising a second ground plane portion;

a first electrical connection between the first part and the second part;

a single variable reactive component included in a second electrical connection between the first ground plane portion and the second ground plane portion; and a controller configured to control performance of the antenna by controlling the single variable reactive component to have a first reactance value for first resonant frequency matching first operational frequency of the antenna and by controlling the single variable reactive component to have a second reactance value for second resonant frequency matching second operational frequency of the antenna, wherein each resonant frequency is determined based on at least the first ground plane portion, the second ground plane portion, the first electrical connection, the second electrical connection and the single variable reactive component.

2. The apparatus as claimed in claim 1, wherein the reactance value of the single variable reactive component is such that a variation in the reactance value significantly degrades the operational performance of the antenna.

3. The apparatus as claimed in claim 1, wherein the reactance value of the single variable reactive component is such that doubling the reactance value degrades the performance of the antenna.

4. The apparatus as claimed in claim 1, wherein the reactance value of the single variable reactive component is such that halving the reactance value degrades the performance of the antenna.

5. The apparatus as claimed in claim 1, wherein the single variable reactive component is in series connection with the second electrical connection and the second electrical connection is in parallel connection with the first electrical connection.

6. The apparatus as claimed in claim 1, wherein the single variable reactive component is a capacitor.

7. The apparatus as claimed in claim 1, wherein the single variable reactive component has a capacitance of between 0.5 and 10 pF.

8. The apparatus as claimed in claim 1, wherein the single variable reactive component is an inductor.

9. The apparatus as claimed in claim 1, wherein second electrical connection has a fixed physical length.

10. The apparatus as claimed in claim 1, wherein single variable reactive component has a variable reactance value.

11. The apparatus as claimed in claim 1, wherein the first electrical connection comprises a flexible collection of cables.

12. The apparatus as claimed in claim 1, wherein the first electrical connection comprises a coaxial cable.

13. The apparatus as claimed in claim 1, wherein the first electrical connection connects first circuitry in the first part with second circuitry in the second part.

14. The apparatus as claimed in claim 1, wherein the first circuitry includes the antenna.

15. The apparatus as claimed in claim 1, further comprising an interface region that joins the first and second parts, wherein the single variable reactive component is located in the interface region.

16. The apparatus as claimed in claim 1, wherein the first and second parts are foldable relative to one another about a hinge.

* * * * *